US007390078B2

(12) United States Patent
Bell et al.

(10) Patent No.: US 7,390,078 B2
(45) Date of Patent: Jun. 24, 2008

(54) REDUCTION OF HEAT LOSS IN MICRO-FLUID EJECTION DEVICES

(75) Inventors: Byron V. Bell, Paris, KY (US); Robert W. Cornell, Lexington, KY (US); Yimin Guan, Lexington, KY (US); Burton L. Joyner, II, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 404 days.

(21) Appl. No.: 11/170,894

(22) Filed: Jun. 30, 2005

(65) Prior Publication Data

US 2007/0002101 A1 Jan. 4, 2007

(51) Int. Cl.
*B41J 2/05* (2006.01)

(52) U.S. Cl. ..... 347/63; 347/64

(58) Field of Classification Search ..... 347/20, 347/44, 45, 47, 54, 56, 61–65, 67
See application file for complete search history.

(56) References Cited

U.S. PATENT DOCUMENTS

| | | | | |
|---|---|---|---|---|
| 5,204,689 | A * | 4/1993 | Shirato et al. | 347/58 |
| 5,706,041 | A | 1/1998 | Kubby | 347/65 |
| 5,707,041 | A | 1/1998 | Bovee et al. | 251/315.04 |
| 5,851,412 | A | 12/1998 | Kubby | 347/65 |
| 5,861,902 | A | 1/1999 | Beerling | 347/63 |
| 6,162,046 | A | 12/2000 | Young et al. | 431/11 |
| 6,273,555 | B1 | 8/2001 | Hess | 347/63 |
| 6,629,750 | B2 | 10/2003 | Ciordia | 347/36 |
| 6,637,866 | B1 * | 10/2003 | Cornell et al. | 347/64 |
| 6,740,416 | B1 * | 5/2004 | Yokogawa et al. | 428/446 |
| 6,767,081 | B2 | 7/2004 | Shirakawa et al. | 347/64 |
| 6,821,554 | B2 | 11/2004 | Smith et al. | 427/96 |
| 2005/0100728 | A1 | 5/2005 | Ristic-Lehmann et al. | 428/323 |

FOREIGN PATENT DOCUMENTS

| | | |
|---|---|---|
| JP | 63-019270 | 1/1988 |
| JP | 63-257652 | 10/1988 |

OTHER PUBLICATIONS

"Aerogels and Applications for Thermal Insulation" by John Creasey, Lockheed Martin—England ASEN 5519 Project Fall 1999.
"NANOGLASS® Porous Dielectrics: Manufacturable and Extendible" by Bedwell, et al., Honewell Electronic Materials, 2002.

* cited by examiner

*Primary Examiner*—Juanita D. Stephens
(74) *Attorney, Agent, or Firm*—Luedeka, Neely & Graham PC

(57) ABSTRACT

The present disclosure is directed to a micro-fluid ejection head for a micro-fluid ejection device. The head includes a semiconductor substrate, a fluid ejection actuator supported by the semiconductor substrate, a nozzle member containing nozzle holes attached to the substrate for expelling droplets of fluid from one or more nozzle holes in the nozzle member upon activation of the ejection actuator. The substrate further includes a thermal insulating barrier layer between the semiconductor substrate and the fluid ejection actuator. The thermal insulating barrier layer includes a porous, substantially impermeable material having a thermal conductivity of less than about 1 W/m-K.

19 Claims, 3 Drawing Sheets

REDUCTION OF HEAT LOSS IN MICRO-FLUID EJECTION DEVICES

FIELD OF THE DISCLOSURE

The present disclosure is generally directed to an improved micro-fluid ejection device. More particularly, the disclosure is directed toward the use of certain insulating materials to improve the energy efficiency of a fluid ejection actuator by reducing heat losses from the ejection actuator to an underlying semiconductor substrate.

BACKGROUND AND SUMMARY

A micro-fluid ejector device, such as a thermal ink jet printer, forms an image on a printing surface by ejecting small droplets of ink from an array of nozzles on an ink jet printhead as the printhead traverses the print medium. The fluid droplets are expelled from a micro-fluid ejection head when a pulse of electrical current flows through the fluid ejector actuator on the ejection head. When the fluid ejection actuator is a resistive fluid ejector actuator, vaporization of a small portion of the fluid creates a rapid pressure increase that expels a drop of fluid from a nozzle positioned over the resistive fluid ejector actuator. Typically, there is one resistive fluid ejector actuator corresponding to each nozzle of a nozzle array on the ejection head. The resistive fluid ejector actuators are activated under the control of a microprocessor in the controller of micro-fluid ejection device.

In the case of resistive fluid ejector actuators, electrical energy pulses applied to the fluid ejector actuators must be sufficient to vaporize the fluid, such as ink. Any energy produced by the resistive fluid ejector actuator that is not absorbed by the fluid or used to vaporize the fluid ends up being absorbed into the semiconductor substrate of the micro-fluid ejection head. Hence, the total energy applied to the fluid ejector actuator includes the energy absorbed by the substrate, the energy absorbed by the fluid, and the energy used to vaporize the fluid. Excess energy may result in an undesirable and potentially damaging overheating of the micro-fluid ejection head.

Furthermore, because it is desirable to expel fluid as quickly as possible, there is a continual push to increase the number of droplets expelled per unit of time. Unfortunately, as the number of ejection pulses in any given amount of time increases, the heat generated in the micro-fluid ejection head also increases. If the ejection head becomes too hot, the delicate semiconductor structures in the substrate may be damaged. Accordingly, it has become convention in the manufacture of micro-fluid ejection heads to incorporate a thermal barrier layer between the fluid ejector actuators and the substrate.

For example, with reference to FIG. 1, conventional micro-fluid ejection head 10 include a semiconductor substrate 12, e.g., a silicon substrate, having an oxide barrier layer 14 applied thereto to serve as a thermal barrier between the silicon substrate and a resistive layer 16 that provides the fluid ejector actuators 17. One or more protective layers 18 are provided on the resistive layer 16 to protect the resistive layer from chemical and mechanical damage. The oxide barrier layer 14 is typically a relatively dense and substantially continuous film of a thermal oxide with, optionally, a layer of borophososilicate glass on one side thereof. Conventional oxide barrier layers 14 function to prevent the energy from the ejector actuators 17 from migrating into the silicon substrate 12. However, the specific heat of the barrier layer 14 typically results in a significant absorption or collection by the barrier layer 14 of heat from the ejector actuators, which results in heat losses that reduce the thermal efficiency of the micro-fluid ejection head 10.

Therefore, a need exists for a way to reduce heat losses to adjacent layers of a micro-fluid ejection head to provide semiconductor devices, such as micro-fluid ejection heads, having improved thermal and electrical efficiency.

The foregoing and other needs may be provided by an improved micro-fluid ejection head for a micro-fluid ejection device as described herein. The micro-fluid ejection head includes a semiconductor substrate, a plurality of fluid ejection actuators supported by the semiconductor substrate, a nozzle member containing nozzle holes attached to the substrate for expelling droplets of fluid from one or more nozzle holes in the nozzle member upon activation of the ejection actuators. The substrate further includes a thermal insulating barrier layer disposed between the semiconductor substrate and the fluid ejection actuators. The thermal insulating barrier layer includes a porous, substantially impermeable material having a thermal conductivity of less than about 1 W/m-K.

In another embodiment, there is provided a micro-fluid ejection structure for expelling droplets of fluid. The fluid ejection structure includes a thermal fluid ejector actuator wherein the thermal fluid ejector actuator increases in temperature and vaporizes a volume of fluid in contact therewith when a voltage is applied to the thermal fluid ejection actuator. A semiconductor substrate for supporting the thermal fluid ejection actuator is provided. An insulating layer having a thermal conductivity of less than about 1 W/m-K is disposed between the thermal fluid ejection actuator and the semiconductor substrate.

Yet another embodiment of the disclosure provides a method for reducing energy consumption for a micro-fluid ejection head. The method includes depositing a thermal insulating layer having a thermal conductivity of less than about 1 W/m-K on a semiconductor support substrate. A resistive layer is deposited on the semiconductor support substrate to provide a fluid ejector actuator. The thermal insulating layer is disposed between the resistive layer and the support substrate.

According to exemplary embodiments provided herein, the porous, substantially impermeable material providing the insulating layer serves to reduce the flow of heat from the ejector actuators toward the silicon layer, thus minimizing heat losses during activation of the ejector actuators during fluid ejection operations.

The above described embodiment improves upon the prior art in a number of respects. The structure of the present disclosure may significantly lower the energy consumption of the fluid ejector actuator by reducing heat dissipation to the area surrounding the ejector actuator and thereby minimize problems associated with over heating of the substrate. The disclosure lends itself to a variety of applications in the field of micro-fluid ejection devices, and particularly in regards to energy efficient inkjet printheads.

BRIEF DESCRIPTION OF THE DRAWINGS

Further advantages of exemplary embodiments disclosed herein may become apparent by reference to the detailed description of preferred embodiments when considered in conjunction with the drawings, which are not to scale, wherein like reference characters designate like or similar elements throughout the several drawings as follows.

DETAILED DESCRIPTION OF EXEMPLARY EMBODIMENTS

Figure 2A:
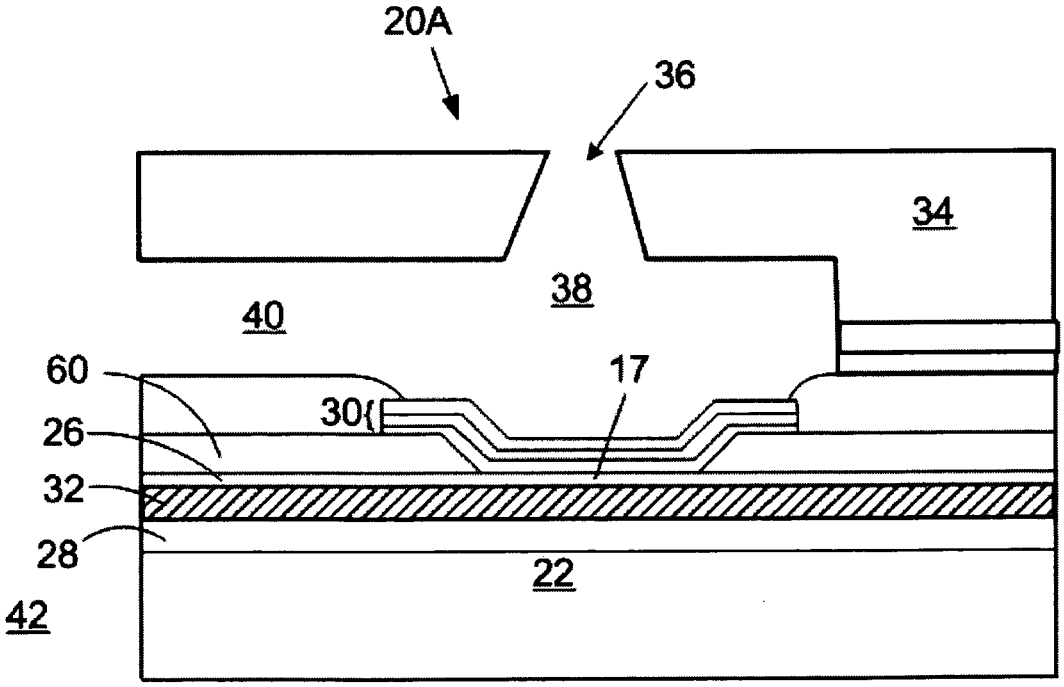
FIG. 2A is a cross-sectional view, not to scale, of a portion of a micro-fluid ejection head in accordance with a preferred embodiment of the disclosure.
Figure 2B:
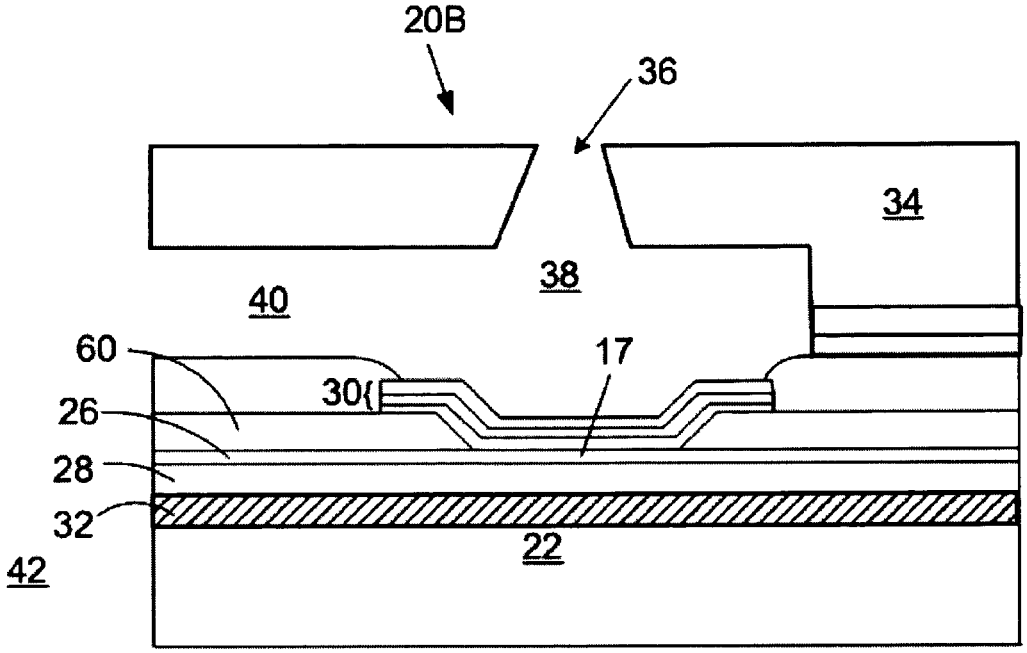
FIG. 2B is a cross-sectional view, not to scale, of a portion of a micro-fluid ejection device in accordance with another embodiment of the disclosure.
Figure 2C:
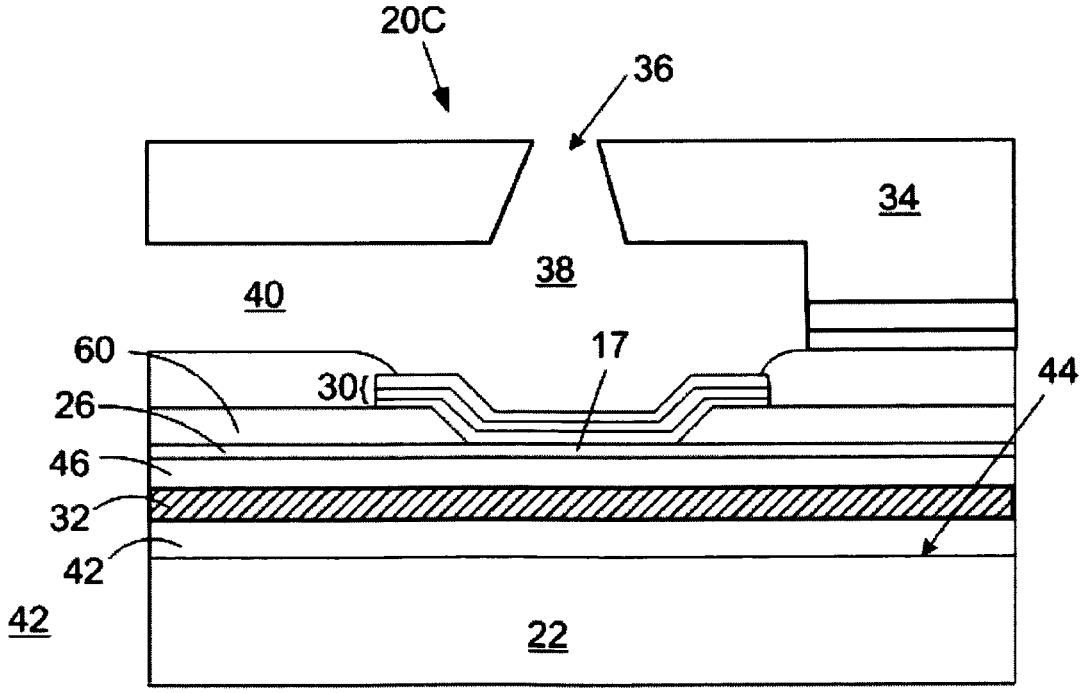
FIG. 2C is a cross-sectional view, not to scale, of a portion of a micro-fluid ejection device in accordance with yet another embodiment of the disclosure.

Referring now to FIGS. 2A-2C, micro-fluid ejection heads 20A-20C according to exemplary embodiments of the present disclosure are illustrated. Each of the ejection heads 20A-20C may include an ejector actuator 17, such as resistance heaters, made using conventional semi-conductor manufacturing techniques such as chemical vapor deposition (CVD), sputtering, spinning, physical vapor deposition (PVD), etching and the like. The ejection actuators may also be provided by other micro-fluid ejection devices, such as piezoelectric actuators. The ejection heads 20A-20C of the exemplary embodiments advantageously incorporate a low thermal diffusivity film between the ejector actuator 17 and the underlying semiconductor substrate 22 to advantageously inhibit heat loss from activation of the fluid ejector actuator 17.

Referring now to FIG. 2A, there is shown a fluid ejection head 20A for use in a micro-fluid ejection device. The ejection head 20A includes a semiconductor substrate 22, such as a silicon substrate, having a fluid ejector actuator 17 provided by, for example a resistive layer 26 disposed on the substrate 22. An insulating layer 28 is disposed on the substrate 22 between the substrate 22 and the actuator 17. One or more protective layers 30 overlie the fluid ejector actuator 17. In accordance with the disclosure, a low thermal diffusivity film 32 is applied between the fluid ejector actuator 17 and the substrate 22, preferably overlying the insulating layer 28 in the embodiments illustrated in FIG. 2A, to reduce heat loss from the fluid ejector actuator 17 toward the substrate 22. The film 32 may be discretely applied to locations underneath each actuator 17 provided by the resistive layer 26 or the film 32 may be applied over a larger area of the substrate 22 that includes the area between the resistive layer 26 and the substrate 22.

The ejection heads 20A-20C described herein may also include a nozzle member, such as plate 34, including nozzle holes therein such as nozzle hole 36, a fluid chamber 38, and a fluid supply channel 40, collectively referred to as flow features. The flow features are in fluid flow communication with a source of fluid to be ejected, such as may be accomplished by having the flow features in flow communication with a feed slot 42 or the like formed in the substrate 22 for supplying fluid from a fluid supply reservoir associated with the ejection heads 20A-20C and ejector actuators 17. In use, the actuators 17 are electrically activated to eject fluid from the ejection heads 20A-20C via the nozzle holes 36. The configuration of the disclosure advantageously provides the low thermal diffusivity film 32 between the actuators 17 and the substrate 22, such as to reduce the travel of heat from activation of the actuators 17 into the substrate 22, thus minimizing heat losses during activation of the actuators 17 during a fluid ejection operation.

The embodiment of FIG. 2B is similar to that of FIG. 2A, except that the low thermal diffusivity film 32 is applied at a location between the insulating layer 28 and the substrate 22, but still between the fluid ejector actuators 17 and the substrate 22.

With reference to FIG. 2C, there is shown an alternate embodiment wherein the insulating layer 28 is eliminated. Instead, the low thermal diffusivity film 32 is applied over a layer of borophososilicate glass (BPSG) 42 (or other planarization layer) which is applied directly to a surface 44 of the substrate 22. A rigid support film 46 may be included to provide mechanical support for the resistive layer 26. The rigid support film 46 may include an oxide film, but may be otherwise as well, such as a silicon nitride, silicon carbide, or other relatively rigid film layer capable of supporting the resistive layer 26 as the low diffusivity film 32 is relatively weak in that regard and may not be able to adequately support the resistive layer 26.

The low thermal diffusivity film 32 can be made of an aerogel material, such as an aerogel material based on silica, titania, alumina, or other ceramic oxide materials. Aerogels are materials composed of ceramic materials fabricated from a sol-gel by evacuating the solvent to leave a network of the ceramic material that is primarily air by volume, so as to be of high porosity, but substantially impermeable so as to inhibit heat transfer therethrough.

In this regard, and without being bound by theory, it is believed that aerogel structures typically have a porosity greater than about 95%, but with a pore size of the aerogel material that is less than the mean free path of air molecules at atmospheric pressure, e.g., less than about 100 nanometers. Because of the small pore size, the mobility of air molecules within the material is restricted and the material can be considered to be substantially impermeable. Under atmospheric conditions, air has a thermal conductivity of about 0.25 W/m K (watts per meter Kelvin).

Accordingly, because the travel of air is so restricted, the resulting aerogel material may be made to have a thermal conductivity that approaches or is lower than the thermal conductivity of air. In this regard, the film 32 can have a thermal conductivity of less than about 1 W/m-K, such as less than about 0.3 W/m-K, and is preferably provided in a thickness of from about 3,000 Angstrom to about 10,000 Angstrom, most preferably from about 4,000 to about 6,000 Angstrom.

An exemplary aerogel material is available from Honeywell Electronic Materials of Sunnyvale, Calif. under the trade name NANOGLASS. Aerogel material provided under the NANOGLASS trade name has a thermal conductivity of about 0.207 W/m-K, and a pore radius ranging from about 2 to about 4 nanometers. The aerogel material may be applied to the substrate 22 to provide film 32 by a spin-on process, followed by a thermal curing process via hot plate, or furnace. One process for making a suitable film 32 is described in U.S. Pat. No. 6,821,554 to Smith et al., the disclosure of which is incorporated herein by reference.

Figure 4:
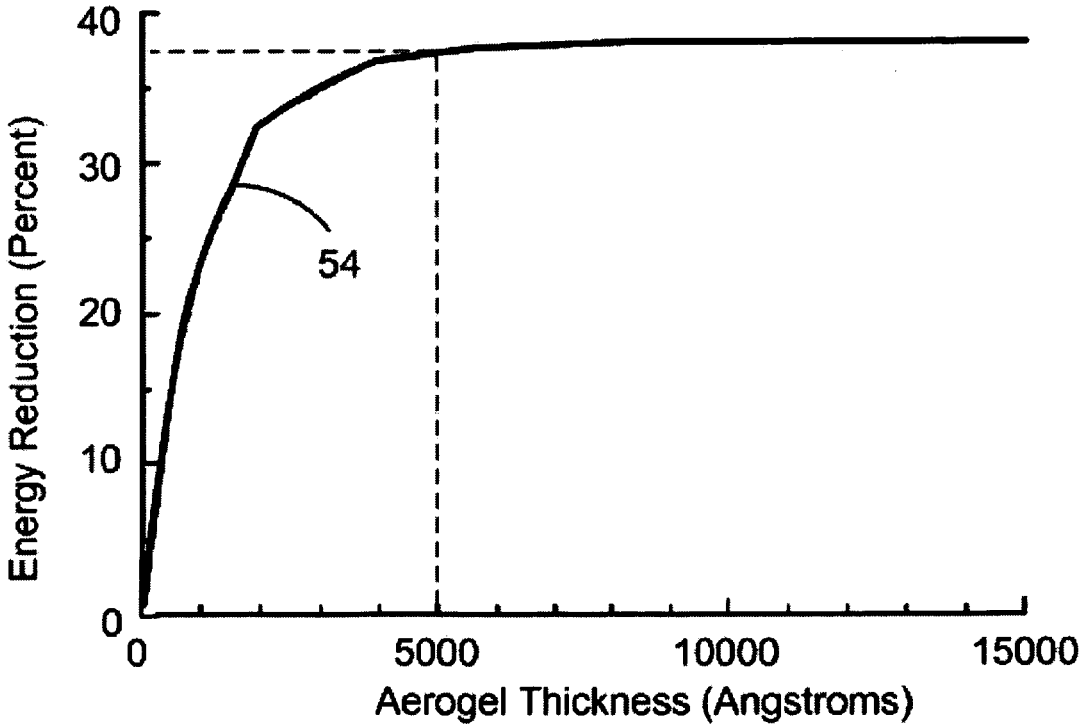
FIG. 4 is a graph of the energy reduction achieved versus thickness of a thermal insulating barrier layer used in an ejection head in accordance with the disclosure.

The foregoing ejection head structures 20A-20C of FIGS. 2A-2C illustrate exemplary structures for incorporating an aerogel film layer 32 in the ejection heads 20A-20C, it being appreciated that the various examples have in common the provision of a low thermal diffusivity film 32, preferably an aerogel film, at locations between at least the fluid ejector actuators 17 and the substrate 22, such as to reduce the amount of heat lost into the substrate 22. This reduction in heat loss can be seen by examination of the graph of FIG. 4, which is a graph of the heater energy per unit volume required to expel a droplet of ink versus the thickness of the heater chip for a conventional heater chip and a heater chip incorporating an aerogel thermal diffusivity layer 32 in accordance with the disclosure.

Figure 1:
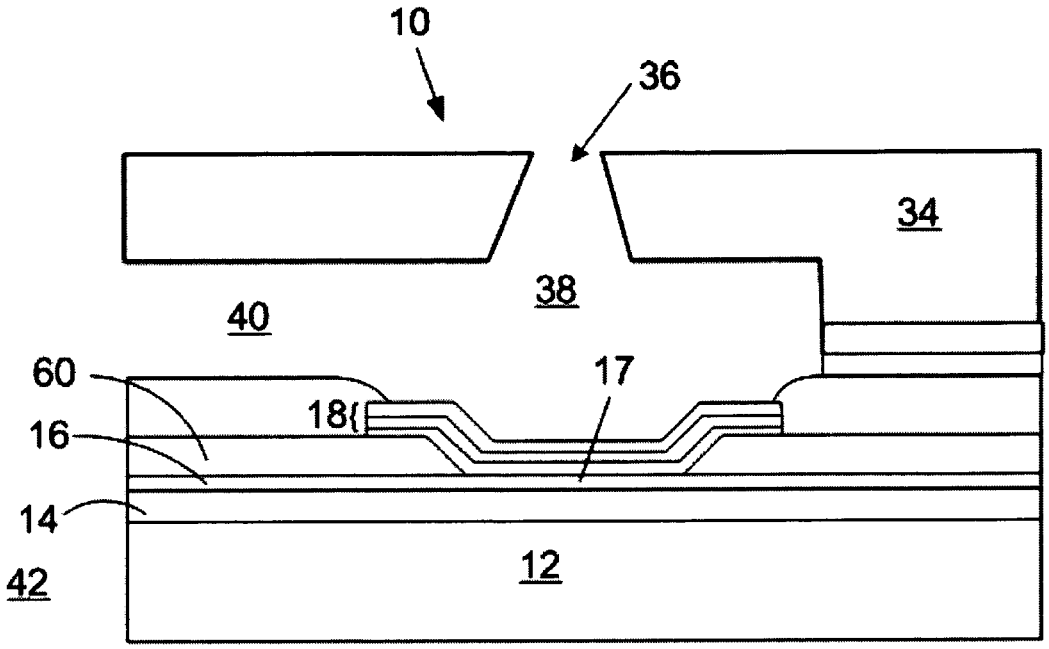
FIG. 1 Prior Art
FIG. 1 is a cross-sectional view, not to scale, of a portion of a prior art micro-fluid ejection head.
Figure 3:
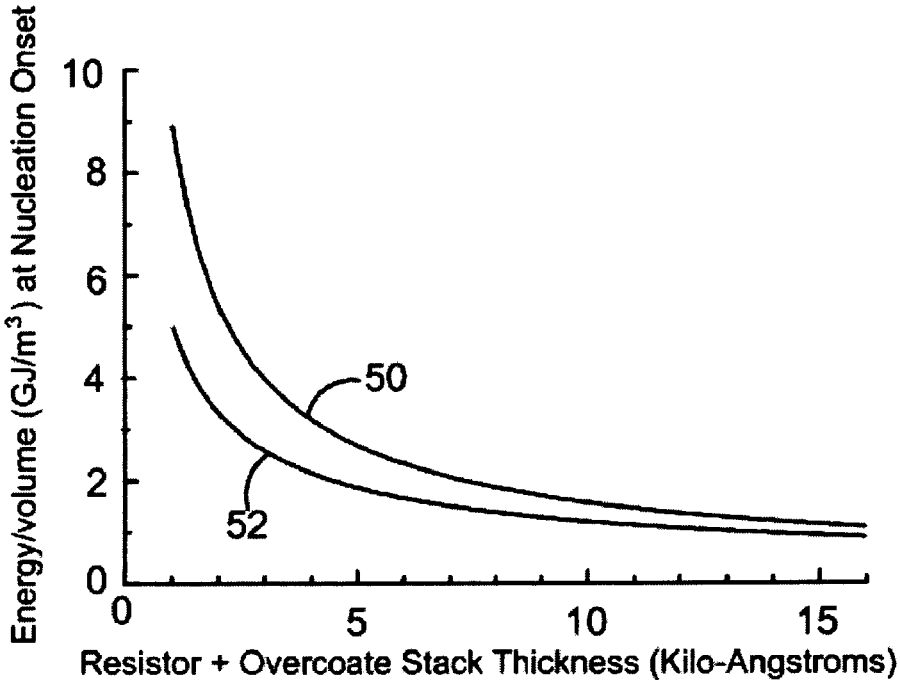
FIG. 3 is a graph of the heater energy per unit volume required to expel a droplet of fluid versus the thickness of an ejection head for a conventional ejection head and an ejection head incorporating thermal insulating barrier layer in accordance with the disclosure.

For example, curve 50 of FIG. 3 represents a conventional ejection head having a $SiO_2$/BPSG insulating layer 14 corresponding to the ejection head 10 illustrated in FIG. 1. Curve 52 of FIG. 3 corresponds to the structure 20A of FIG. 2A, with the thermal diffusivity layer 32 having a thermal conductivity of about 0.2 W/m-K. As will be noted by FIG. 3, the energy requirements are significantly reduced when an ejection head according to the disclosure is used.

As noted previously, the thermal diffusivity layer 32 is preferably provided in a thickness of from about 3,000 Angstrom to about 10,000 Angstrom, most preferably from about 4,000 to about 6,000 Angstrom. In this regard, and with reference to FIG. 4, there is shown a graph of the thickness of the thermal diffusivity layer 32 versus the percent energy reduction for a micro-fluid ejection head obtained by inclusion of the thermal diffusivity layer 32 on a conventional heater chip having a $SiO_2$/BPSG insulating layer. The thermal diffusivity layer 32 is a layer as in the case of FIG. 3, having a thermal conductivity of about 0.2 W/m-K. Curve 54 increases dramatically in relation to the thickness of the thermal diffusivity layer 32, leveling off at a thickness of about 4,000 to about 6,000 Angstroms with very little benefit being achieved after a thickness of about 10,000 Angstroms. As will be noted from FIG. 4, a thickness of 5,000 Angstroms for the thermal diffusivity layer 32 yields a reduction in power consumption of about 37 percent.

With respect to the other components of the ejection heads 20A-20C, the fluid ejector actuators 17 may be a conventional fluid ejector actuators and may be provided as by a layer of resistive material such as tantalum-aluminum (Ta—Al), or other materials such as TaAlN, TaN, $HfB_2$, $ZrB_2$, with an overlying layer 60 of a conductive metal. Typically, the layer 26 of resistive material has a thickness ranging from about 800 Angstroms to about 1600 Angstroms. A portion of the conductive metal layer 60 is etched off of resistive layer 26 to provide the fluid ejector actuator 17. In the region where the metal layer has been etched away, the current primarily flows through the relatively higher resistance layer 26, thereby heating up the resistive layer 26 and fluid in contact with the resistive layer 26 to provide the fluid ejector actuator 17.

Current is carried to the fluid ejector actuator 17 by the low resistance metal layer 60 attached to resistive layer 26. The metal layer 60 may be made of a variety of conductive materials including, but not limited to, gold, copper, aluminum, and alloys thereof, and is electrically connected to conductive power and ground busses to provide electrical pulses from an ejection controller in a micro-fluid ejection device such as an inkjet printer to the fluid ejector actuators 17. The metal layer 60 may preferably have a thickness ranging from about 4,000 Angstroms to 15,000 Angstroms.

The substrate 22 is preferably a semiconductor substrate made from silicon of a type commonly used in the manufacture of ink jet printer heater chips. The substrate 22 typically has a thickness ranging from about 200 to about 800 microns.

The insulating layer 28 may be deposited as by using a CVD or PVD process or by thermal oxidation of a surface of the silicon substrate 22. In that regard, the insulating layer 28 is preferably a thermal oxide layer and a layer of borophososilicate glass. Further examples of materials for providing the insulating layer 28 include silicon nitride (SiN), silicon dioxide ($SiO_2$) or boron (BPSG) and/or phosphorous doped glass (PSG). Such materials serve to provide electrical and thermal insulation between the substrate 22 and the overlying structure providing the fluid ejector actuator 17. The insulating layer 28 preferably has a thickness ranging from about 8,000 to about 30,000 Angstroms. The thermal conductivity of the thermal insulation layer 28 is typically between 1 and 20 W/m-K.

The protective layer 30 may be any corrosion resistant material such as silicon nitride, silicon carbide, tantalum, diamond-like carbon, and the like. A combination of one or more of the foregoing materials may be used as the protective layer 30. Protective layer 30 thicknesses typically range from about 1000 to about 5000 Angstroms.

It is contemplated, and will be apparent to those skilled in the art from the preceding description and the accompanying drawings that modifications and/or changes may be made in the embodiments of the disclosure. Accordingly, it is expressly intended that the foregoing description and the accompanying drawings are illustrative of preferred embodiments only, not limiting thereto, and that the true spirit and scope of the present disclosure be determined by reference to the appended claims.

The invention claimed is:

1. A micro-fluid ejection head for a micro-fluid ejection device, the head comprising a semiconductor substrate, a first layer selected from the group consisting of a thermal oxide layer, a planarization layer, and a combination of thermal oxide layer and planarization layer adjacent to the semiconductor substrate, a fluid ejection actuator supported by the semiconductor substrate and first layer, a nozzle member containing nozzle holes attached to the substrate for expelling droplets of fluid from one or more nozzle holes in the nozzle member upon activation of the ejection actuator, wherein the substrate further comprises a thermal insulating barrier layer between the first layer and the fluid ejection actuator wherein the thermal insulating barrier layer comprises a porous, substantially impermeable material having a thermal conductivity of less than about 1 W/m-K.

2. The ejection head of claim 1, wherein the porous, substantially impermeable material has a thickness ranging from about 3,000 to about 10,000 Angstroms.

3. The ejection head of claim 1, wherein the first layer comprises a thermal oxide layer disposed on the semiconductor substrate between the porous, substantially impermeable material and the semiconductor substrate.

4. The ejection head of claim 1, further comprising a thermal oxide layer disposed on the semiconductor substrate between the porous, substantially impermeable material the ejection actuator.

5. The ejection head of claim 1, wherein the first layer comprises a planarization layer disposed on the semiconductor substrate between the porous, substantially impermeable material and the semiconductor substrate.

6. The ejection head of claim 1, wherein the ejection head comprises a thermal inkjet print head.

7. The ejection head of claim 1, further comprising a rigid support film disposed on the semiconductor substrate between the porous, substantially impermeable material and the ejection actuator.

8. A micro-fluid ejection structure for expelling droplets of fluid, said fluid ejection structure comprising:

a thermal fluid ejector actuator wherein said thermal fluid ejector actuator increases in temperature and vaporizes a volume of fluid in contact therewith when a voltage is applied to said thermal fluid ejection actuator;

a semiconductor substrate supporting said thermal fluid ejection actuator;

a first layer selected from the group consisting of a thermal oxide layer, a planarization layer, and a combination of thermal oxide layer and planarization layer adjacent to the semiconductor substrate, and an insulating layer having a thermal conductivity of less than about 1 W/m-K disposed between the thermal fluid ejection actuator and the first layer.

9. The fluid ejection structure of claim 8, wherein said insulating layer has a thickness ranging from about 3,000 to about 10,000 Angstroms.

10. The fluid ejection structure of claim 8, wherein the first layer comprises a thermal oxide layer disposed between the insulating layer and the semiconductor substrate.

11. The fluid ejection structure of claim 8, further comprising a thermal oxide layer disposed between the insulating layer and the fluid ejection actuator.

12. The fluid ejection structure of claim 8, wherein the first layer comprises a planarization layer disposed between the insulating layer and the semiconductor substrate.

13. The fluid ejection structure of claim 8, further comprising a rigid support film overlying the insulating layer between the insulating layer and the fluid ejection actuator.

14. A method for reducing energy consumption for a micro-fluid ejection head, comprising the steps of:

depositing a thermal insulating layer having a thermal conductivity of less than about 1 W/m-K onto a first layer selected from the group consisting of a thermal oxide layer, a planarization layer, and a combination of thermal oxide layer and planarization layer adjacent to a semiconductor support substrate; and depositing a resistive layer on the semiconductor support substrate to provide a fluid ejector actuator, wherein the thermal insulating layer is disposed between the resistive layer and the first layer.

15. The method of claim 14 wherein the insulating layer is deposited with a thickness ranging from about 3,000 to about 10,000 Angstroms.

16. The method of claim 14, wherein the first layer comprises a thermal oxide layer deposited on the support substrate between the insulating layer and the support substrate.

17. The method of claim 14 further comprising depositing a thermal oxide layer on the support substrate between the insulating layer and the resistive layer.

18. The method of claim 14, wherein the first layer comprises a planarization layer deposited on the support substrate between the insulating layer and the support substrate.

19. The method of claim 14, further comprising depositing a rigid support film on the support substrate between the insulating layer and the resistive layer.

* * * * *